US009868580B2

(12) United States Patent
Toh

(10) Patent No.: US 9,868,580 B2
(45) Date of Patent: Jan. 16, 2018

(54) PACKAGING SYSTEM

(71) Applicant: COLGATE-PALMOLIVE COMPANY, New York, NY (US)

(72) Inventor: Kiat-Cheong Toh, Forest Hills, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 15/502,392

(22) PCT Filed: Aug. 8, 2014

(86) PCT No.: PCT/US2014/050302

§ 371 (c)(1),
(2) Date: Feb. 7, 2017

(87) PCT Pub. No.: WO2016/022144

PCT Pub. Date: Feb. 11, 2016

(65) Prior Publication Data

US 2017/0233162 A1 Aug. 17, 2017

(51) Int. Cl.
*B65D 25/08* (2006.01)
*B65D 81/32* (2006.01)
(Continued)

(52) U.S. Cl.
CPC ..... *B65D 81/3211* (2013.01); *B65D 21/0206* (2013.01); *B65D 47/0876* (2013.01)

(58) Field of Classification Search
USPC ..... 206/219, 222; 222/129; 215/227; 99/289 R
See application file for complete search history.

(56) References Cited

U.S. PATENT DOCUMENTS 4,088,246 A 5/1978 Klingaman
4,201,316 A 5/1980 Klingaman
(Continued)

FOREIGN PATENT DOCUMENTS

AU 2012 100 056 2/2012
EP 2239205 A1 10/2010
(Continued)

OTHER PUBLICATIONS

International Search Report and the Written Opinion of the International Searching Authority issued in International Application PCT/US2014/050302 dated Jun. 9, 2015.

*Primary Examiner* — Jacob K Ackun

(57) ABSTRACT

A primary storage (2) container has a body portion (4), a neck portion (6) extending from the body portion, the neck portion providing an outlet of the primary storage container, an annular fitting (10) on the neck portion for fitting a closure (12) onto the primary storage container and at least one cutting element (14) extending outwardly of the fitting in a direction away from the outlet (8); and wherein the fitting has a first bayonet coupling (42) for releasably locking into the fitting a flange (36) forming a second bayonet coupling (44). A refill container (32) has a chamber portion (34), filled with a dose of a refill composition, the chamber portion having an annular flange defining (36) an opening (38) of the chamber portion (34), and a frangible film (40) covering the opening and attached to the annular flange (36), wherein the flange (36) has a male bayonet coupling (44). The primary storage container and the refill container (32) are combined in a packaging system.

20 Claims, 8 Drawing Sheets

(51) Int. Cl.
*B65D 21/02* (2006.01)
*B65D 47/08* (2006.01)

(56) References Cited

U.S. PATENT DOCUMENTS

| | | | | |
|---|---|---|---|---|
| 4,705,191 | A | 11/1987 | Itzel et al. | |
| 6,164,495 | A * | 12/2000 | Manesis | A61F 9/0008 222/129 |
| 6,375,041 | B1 | 4/2002 | Klima et al. | |
| 6,820,740 | B1 | 11/2004 | Spector | |
| 2005/0029130 | A1 | 2/2005 | Spector | |
| 2005/0205438 | A1 | 9/2005 | Hierzer et al. | |
| 2007/0023300 | A1 | 2/2007 | Spector et al. | |
| 2009/0120815 | A1 | 5/2009 | Mitchell | |
| 2009/0127274 | A1 | 5/2009 | Mueller et al. | |
| 2009/0236244 | A1* | 9/2009 | Frutin | B65D 51/2892 206/219 |
| 2011/0139890 | A1* | 6/2011 | Soldan | A01M 1/2044 239/44 |
| 2011/0259769 | A1 | 10/2011 | Salinas | |
| 2012/0031277 | A1 | 2/2012 | Hsieh et al. | |

FOREIGN PATENT DOCUMENTS

| | | | |
|---|---|---|---|
| FR | 2 596 731 | | 10/1987 |
| FR | 2 926 794 | A1 | 7/2009 |
| GB | 2474294 | A | 4/2011 |
| JP | H10 59427 | | 3/1998 |
| WO | WO-2006/036148 | A1 | 4/2006 |

* cited by examiner

PACKAGING SYSTEM

BACKGROUND

The present invention relates to a packaging system comprising a primary storage container and a secondary refill container. The present invention also relates to a primary storage container. The present invention further relates to a secondary refill container. The present invention relates in particular to a packaging system for storing a unit dose refill of a concentrated composition, such as a laundry care, home care or personal care composition.

A large variety of containers are known in the art for containing a wide variety of products. In the field of personal care, home care and laundry care compositions, it would be desirable to be able to provide the consumer with a concentrated composition which can be combined with water to form a diluted reconstituted composition at home. This expedient would reduce the total weight of the packed product, and reduce transport costs.

There is a need to design a packaging system which can permit the safe and versatile use of concentrates which can be sold to and used by the consumer, and then reconstituted to form a diluted composition of the required concentration of active components. The present invention at least partly aims to meet that need.

The present invention also aims to provide a packaging system which leas enhanced ergonomic features, in particular which has enhanced versatility for various uses.

BRIEF SUMMARY

The present invention provides a packaging system comprising:

a) a primary storage container having a body portion of a first volume, a neck portion extending from the body portion, the neck portion providing an outlet of the primary storage container, an annular fitting on the neck portion for fitting a closure onto the primary storage container and at least one cutting element extending outwardly of the fitting in a direction away from the outlet; and b) a secondary refill container having a chamber portion, having a second volume smaller than the first volume, filled with a dose of a refill composition, the chamber portion having an annular flange defining an opening, of the chamber portion, and a frangible film covering the opening and attached to the annular flange, wherein the fitting and the flange have complementary respective first and second bayonet couplings which are adapted releasably to lock the flange into the fitting to fit the secondary refill container over the outlet of the primary storage container, and the at least one cutting element is located to cut the frangible film when the first and second bayonet couplings are coupled together.

In this specification the terms "cutting" and "cut" broadly encompass any type of cutting action or associated cutting element, in particular cutting, piercing, severing, tearing, puncturing, etc.

In some embodiments, the first and second bayonet couplings each comprise a pair of opposed bayonet elements.

In some embodiments, the fitting has a female bayonet coupling and the flange has a male bayonet coupling.

In some embodiments, the male bayonet coupling comprises a plurality of flange tabs.

In some embodiments, the secondary refill container is provided in an assembly of plural secondary refill containers, with at least some adjacent containers of the assembly being temporarily interconnected by respective adjacent flange tabs having a line of weakening therebetween.

In some embodiments, the secondary refill container is in the form of a pot or cup.

In some embodiments, the secondary refill container is composed of a thermoformed polymer.

In some embodiments, the secondary refill container is composed of polyethylene, polypropylene or polyethylene terephthalate, or any one or more of these polymers in a monolayer or in a multi-layer laminate, optionally with a barrier layer composed of a resin such as EVOH or nylon.

In some embodiments, the frangible film is compressible and comprises a gasket or the secondary refill container further comprises a gasket member around the annular flange.

In some embodiments, the gasket member is between the annular flange and the frangible film.

In some embodiments, the gasket member is on an outer surface of the frangible film. The gasket member may comprise an expanded polymer.

In some embodiments, the refill composition in the secondary refill container comprises a concentrated liquid hand soap composition.

In some embodiments, the secondary refill container has a color coding correlating with the refill composition therein.

In some embodiments, the fitting is attached to the neck portion.

In some embodiments, the at least one cutting element is integrally molded with the fitting.

In some embodiments, the at least one cutting element comprises a plurality of blade elements around the outlet and extending upwardly along an edge of the outlet.

In some embodiments, the fitting includes a sealing surface at least partially surrounding the outlet for engaging an end surface of the secondary refill container when the secondary refill container is fitted as a closure over the outlet of the primary storage container, a locking, surface spaced from the sealing surface and a gap therebetween for receiving the flange.

In some embodiments, the first bayonet coupling in the fitting includes openings in the locking surface for receiving the second bayonet coupling in the form of bayonet tabs of the flange.

In some embodiments, an integrally molded recess in the fitting forms a pouring spout at one side of the outlet.

In some embodiments, a plurality of support members is integrally molded in the recess to form an upper bearing surface for a portion of the flange when the secondary refill container is fitted as a closure over the outlet of the primary storage container.

In some embodiments, the fitting further comprises a hinged lid for selectively closing the opening in the absence of the secondary refill container.

In some embodiments, the fitting is composed of polypropylene or acrylonitrile butadiene styrene.

In some embodiments, the primary storage container is composed of polyethylene, polypropylene or polyethylene terephthalate, or any one or more of these polymers in a monolayer or in a multi-layer laminate, optionally with a barrier layer composed of a resin such as EVOH or nylon.

In some embodiments, the primary storage container has a further outlet and closure assembly at a location remote from the fitting.

In some embodiments, the further outlet and closure assembly is at a lower end of the primary storage container and the neck portion, the annular fitting and the at least one cutting element are at an upper end of the primary storage container.

In some embodiments, the primary storage container has at least two neck portions extending from the body portion, each neck portion providing a respective outlet of the primary storage container, each neck portion having a respective annular fitting thereon for fitting a respective closure onto the primary storage container, and each fitting having at least one cutting element extending outwardly thereof in a direction away from the respective outlet; and the packaging system comprising at least two of the secondary refill containers.

In some embodiments, each fitting has a respective color.

In some embodiments, each fitting has a respective color corresponding to a color of a respective secondary refill container.

In some embodiments, the primary storage container has a central longitudinal axis, the neck portion is substantially aligned with the central longitudinal axis, and the body portion has a first base support surface opposite to the neck portion.

In some embodiments, the first base support surface is substantially orthogonal to the central longitudinal axis.

In some embodiments the primary storage container is substantially symmetrical about the central longitudinal axis.

In some embodiments, the body portion has a second base support surface inclined to the first base support surface.

In some embodiments, the first and second base support surfaces are mutually separated.

In some embodiments, the at least one cutting element is located to cut at least one arcuate cut through the frangible film when the first and second bayonet couplings are mutually rotated during coupling together.

The present invention further provides a primary storage container having a body portion, a neck portion extending from the body portion, the neck portion providing an outlet of the primary storage container, an annular fitting on the neck portion for fitting a closure onto the primary storage container and at least one cutting element extending outwardly of the fitting in a direction away from the outlet; and wherein the fitting has a first bayonet coupling for releasably locking into the fitting a flange forming a second bayonet coupling.

The present invention further provides a refill container having a chamber portion, filled with a dose of a refill composition, the chamber portion having an annular flange defining an opening of the chamber portion, and a frangible film covering the opening and attached to the annular flange, wherein the flange has a male bayonet coupling.

The present invention can therefore provide a packaging system, in particular for personal care, home care and laundry care compositions, which can provide the consumer with a concentrated composition which can be combined with water to form a diluted reconstituted composition at home, or in a commercial facility. This packaging system can reduce the total weight of the packaged product, and reduce transport costs.

The present invention can also provide a packaging system which can permit the safe and versatile use of concentrates which can be sold to and used by the consumer, and then reconstituted to form a diluted composition of the required concentration of active components.

The present invention can further provide a packaging system which has enhanced ergonomic features, in particular which has enhanced versatility for various uses.

The packaging system of the invention accordingly has particular advantages when used to package a home care, laundry care or personal care compositions, for example liquid hand soaps, cleaning compositions, fabric detergents or fabric softeners or conditioners. The packaged concentrate, to be combined with water by the consumer, may be in liquid or solid form, and may comprise any active ingredient or benefit agent or combination thereof.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring to FIGS. 1 to 7, there is shown a packaging system according to an embodiment of the present invention.

Figure 1:
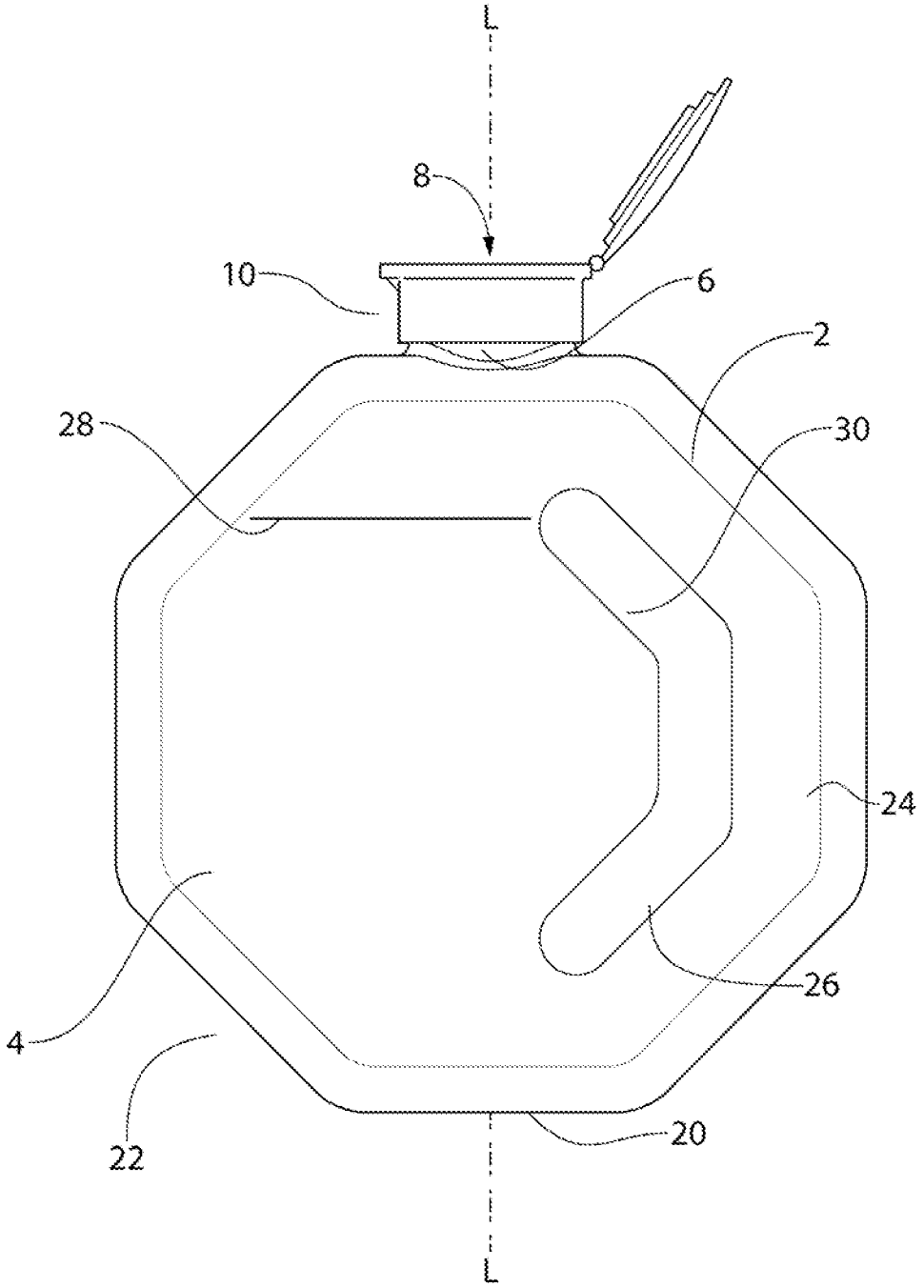
FIG. 1 is a front view of a primary storage contain in the form of a bottle according to a first embodiment of the present invention.

As shown in particular in FIG. 1, the packaging system comprises a primary storage container 2 having a body portion 4 of a first volume, typically from 300 to 6000 ml, typically from 500 to 5000 ml, for example from 750 to 3000 ml. The primary storage container 2 is typically composed of polyethylene, polypropylene or polyethylene terephthalate, or any one or more of these polymers in a monolayer or in a multi-layer laminate, optionally with a barrier layer composed of a resin such as EVOH or nylon, and is typically blow molded. A neck portion 6 extends from the body portion 4. The neck portion 6 provides an outlet 8 of the primary storage container 2.

Figure 2:
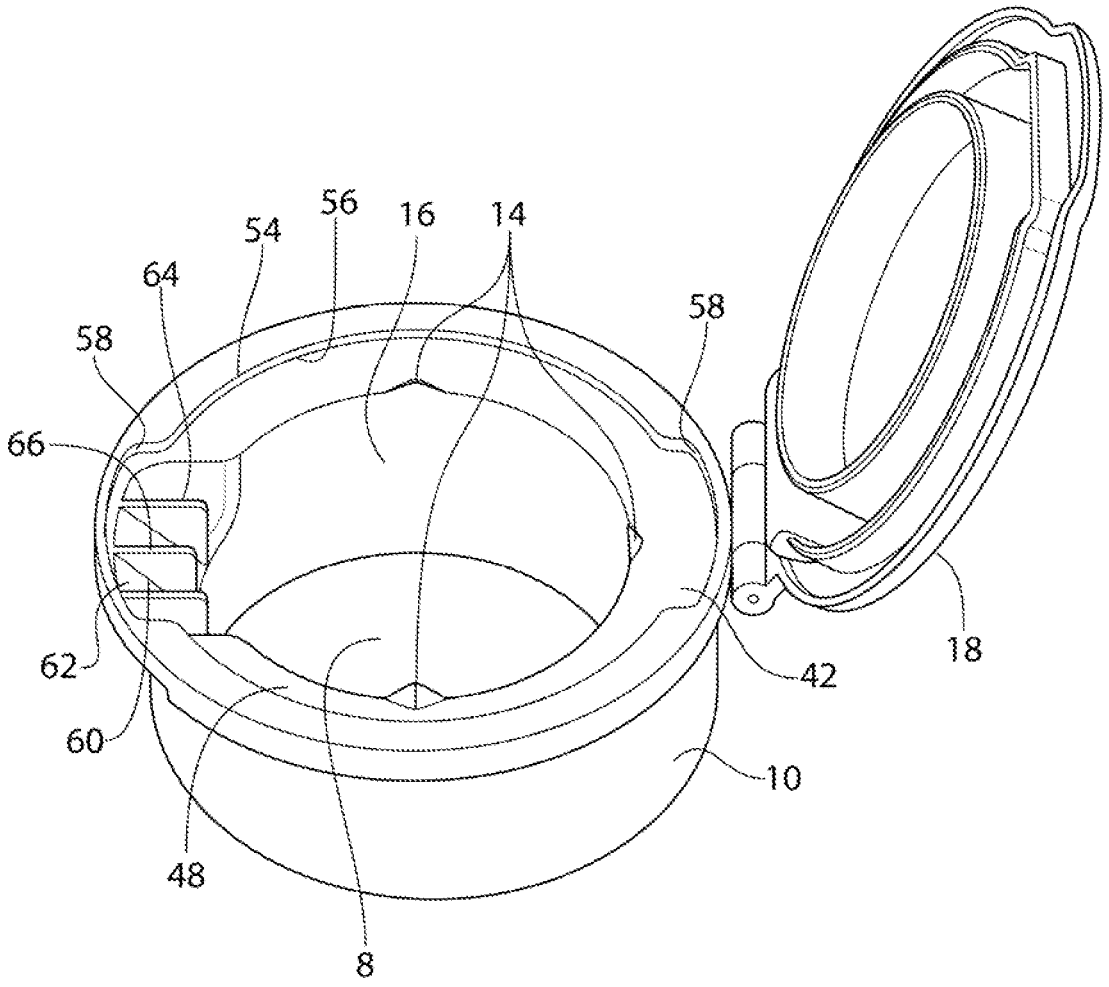
FIG. 2 is a perspective view of a fitting on the bottle of FIG. 1, the fitting being for fitting a closure in the form of a secondary refill container.
Figure 3:
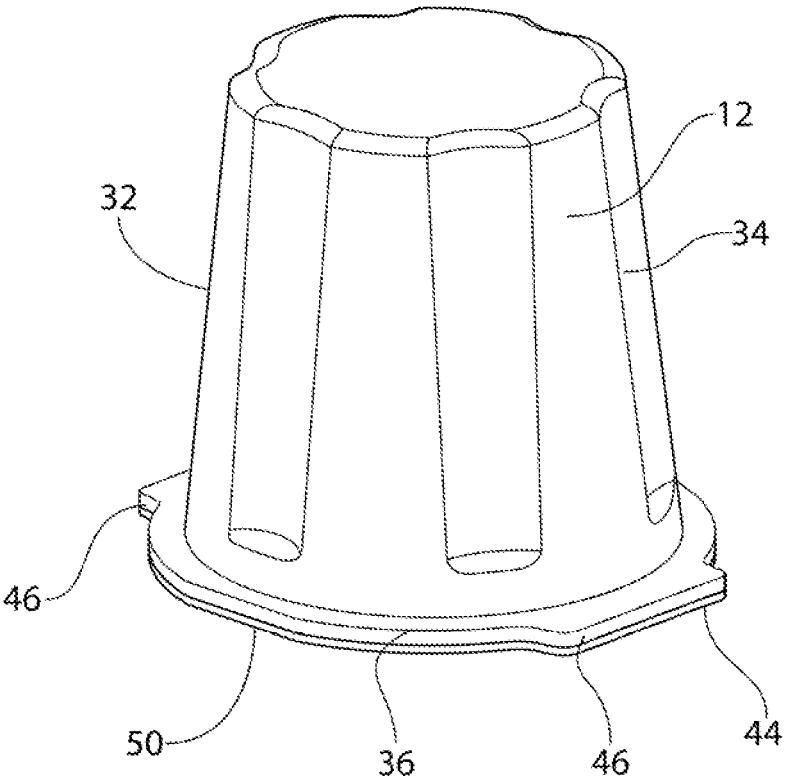
FIG. 3 is a perspective view of a secondary refill container for fitting as a closure to the bottle of FIG. 1.

As shown in particular in FIG. 2, an annular fitting 10 on the neck portion 6 is provided for fitting a closure 12, in the form of a cap, onto the primary storage container 2. In this embodiment, the fitting 10 is attached to the neck portion 6, for example by a threaded coupling, a snap-fit connection, a friction fit, or adhesion or other bonding.

At least one cutting element 14 extends outwardly of the fitting 10 in a direction away from the outlet 8. In the illustrated embodiment three cutting elements 14 are shown, although any number may be provided. The cutting elements 14 are integrally molded with the fitting 10. The cutting elements 14 are blade elements around the outlet 8 and extend upwardly along an edge 16 of the outlet 8. The fitting 10 further comprises a hinged lid 18 for selectively closing the opening 8 in the absence of the closure 12. The fitting 10 is typically injection molded and typically composed of polypropylene or acrylonitrile butadiene styrene.

The primary storage container 2 has a central longitudinal axis L-L. The neck portion 6 is substantially aligned with the central longitudinal axis L-L. The body portion 4 has a first base support surface 20 opposite to the neck portion 6. The first base support surface 20 is substantially orthogonal to the central longitudinal axis L-L. The primary storage container 2 is substantially symmetrical about the central longitudinal axis L-L.

Figure 4:
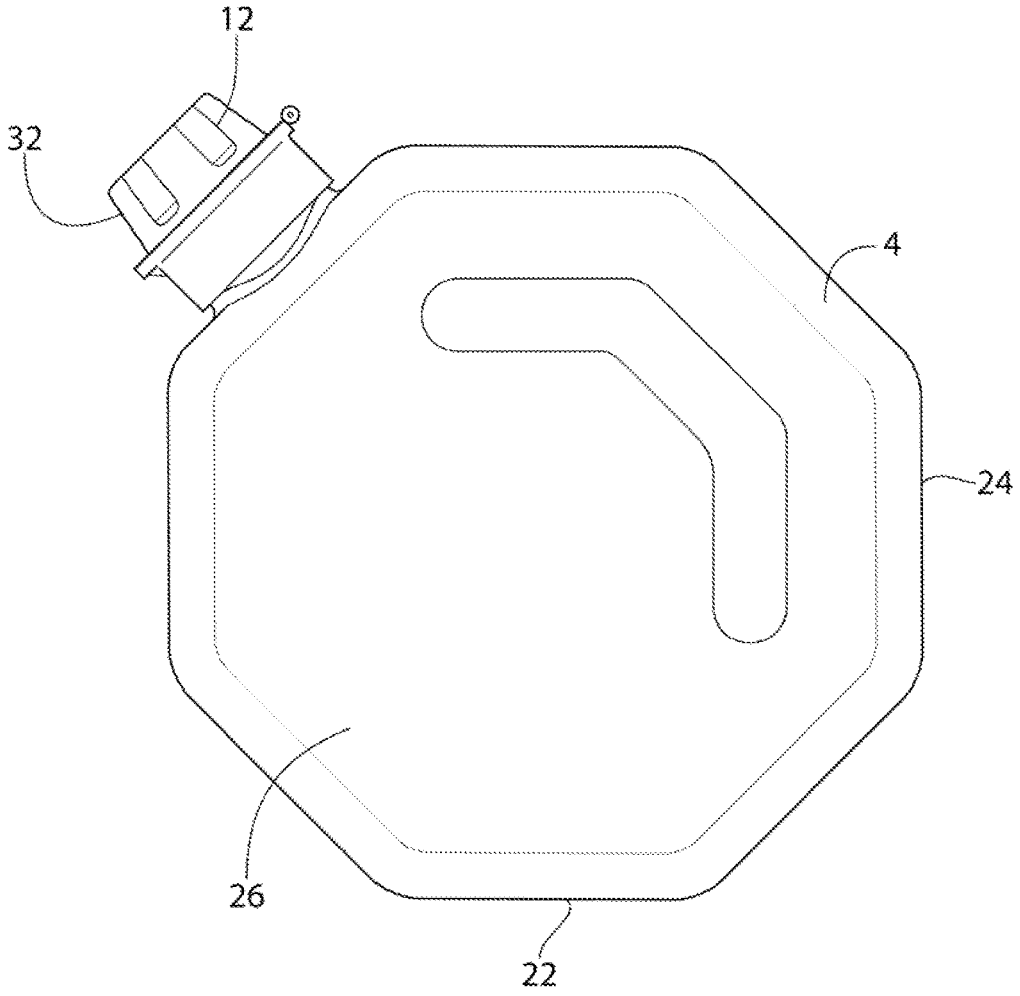
FIG. 4 is a front view of the primary storage container of FIG. 1 with the secondary refill container fitted as a closure.

Referring also to FIG. 4, the body portion 4 has at least one second base support surface 22 inclined to the first base support surface 20. The first and second base support surfaces 20, 22 are mutually separated. In the illustrated embodiment the body portion 4 is formed as a regular octagon, with eight planar side surfaces 24 and two major front/rear surfaces 26, with one of the side surfaces 24 being provided with the outlet 8.

This provides that the primary storage container 2 can readily be filled with a flowable material, such as a liquid, when the outlet 8 is vertically oriented as shown in FIG. 1 and the primary storage container 2 can be stored, displayed or used in a decanting mode when the outlet 8 is inclined to the vertical as shown in FIG. 4. The body portion 4 of the primary storage container 2 has a fill line 28 to assist filling of the container 2 without overfilling and a handle 30, which may be integrally blow molded.

As shown in particular in FIGS. 3, 5, 6 and 8, the closure 12 comprises a secondary refill container 32 having a chamber portion 34. The chamber portion 34 has a second volume, typically from 5 to 600 typically from 10 to 500 ml, for example from 25 to 100 ml, smaller than the first volume of the primary storage container 2. The secondary refill container 32 is in the form of a pot or cup, and typically is composed of a thermoformed polymer, for example polyethylene, polypropylene or polyethylene terephthalate, or any one or more of these polymers in a monolayer or in a multi-layer laminate, optionally with a barrier layer composed of a resin such as EVOH or nylon. The secondary refill container 32 is filled with a unit dose of a refill composition, for example a concentrated liquid hand soap composition. The chamber portion 34 has an annular flange 36 defining an opening 38 of the chamber portion 34. A frangible film 40 covers the opening and is attached to the annular flange 36. The frangible film 40 is typically composed of polyethylene, polypropylene, polystyrene or polyethylene terephthalate or any one or more of these polymers in a monolayer or in a multi-layer laminate, optionally with a barrier layer composed of a resin such as EVOH or nylon. The secondary refill container 32 may have a color coding correlating with the refill composition therein. For example, the color of all or part of the secondary refill container 32 may indicate the nature of the refill composition, for example fragrance, benefit agent (moisturizing, anti-bacterial, etc.) or any other suitable composition.

The fitting 10 and the flange 36 have complementary respective first and second bayonet couplings 42, 44 which are adapted releasably to lock the flange 36 into the fitting 10 to fit the secondary refill container 32 as a closure 12 over the outlet 8 of the primary storage container 2. The cutting elements 14 are located to cut the frangible film 40 when the first and second bayonet couplings 42, 44 are coupled together. The fitting 10 has a female bayonet coupling 42 and the flange 36 has a male bayonet coupling 44. The male bayonet coupling 44 comprises a plurality of flange tabs 46. In the illustrated embodiment, the first and second bayonet couplings 42, 44 each comprise a pair of opposed bayonet elements, although a greater number, for example up to 6, bayonet elements may be provided around the fitting 10 and the flange 36.

The fitting 10 includes a sealing surface 48 at least partially surrounding the outlet 8 for engaging an end surface 50 of the secondary refill container 32 when the secondary refill container 32 is fitted as a closure 12 over the outlet 8 of the primary storage container 2. A locking surface 54 is spaced from the sealing surface 48. A gap 56 between the sealing surface 48 and the locking surface 54 is provided for receiving the flange tabs 46. The first bayonet coupling 42 in the fitting 10 includes openings 58 in the locking surface 54 for receiving the second bayonet coupling 44 in the form of bayonet flange tabs 46 of the flange 36.

An integrally molded recess 60 in the fitting 10 forms a pouring spout 62 at one side of the outlet 8. A plurality of support members 64, in the form of ribs or fins, are integrally molded in the recess 60. The support members 64 form an upper bearing surface 66 for a portion of the flange 36 in when the secondary refill container 32 is fitted as a closure 12 over the outlet 8 of the primary storage container 2.

Figure 5:
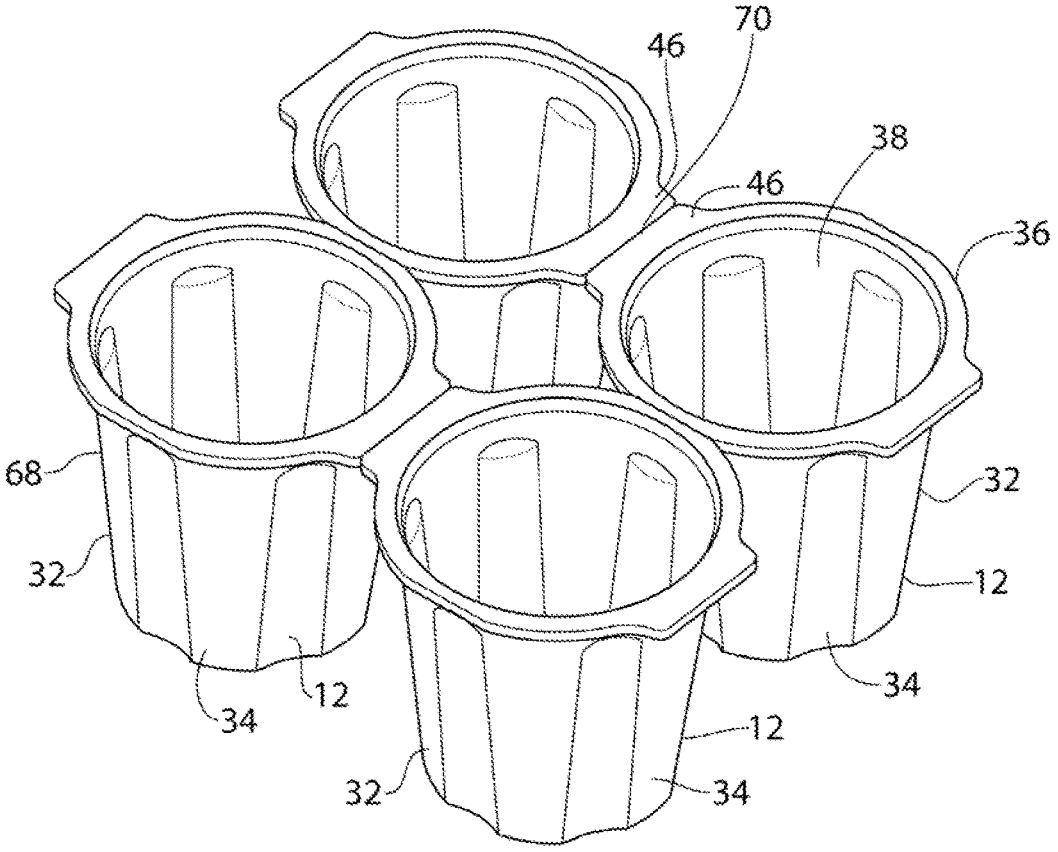
FIG. 5 is a perspective view of an assembly of a plurality of interconnected chamber portions to form plural secondary refill containers of FIG. 3.
Figure 6:
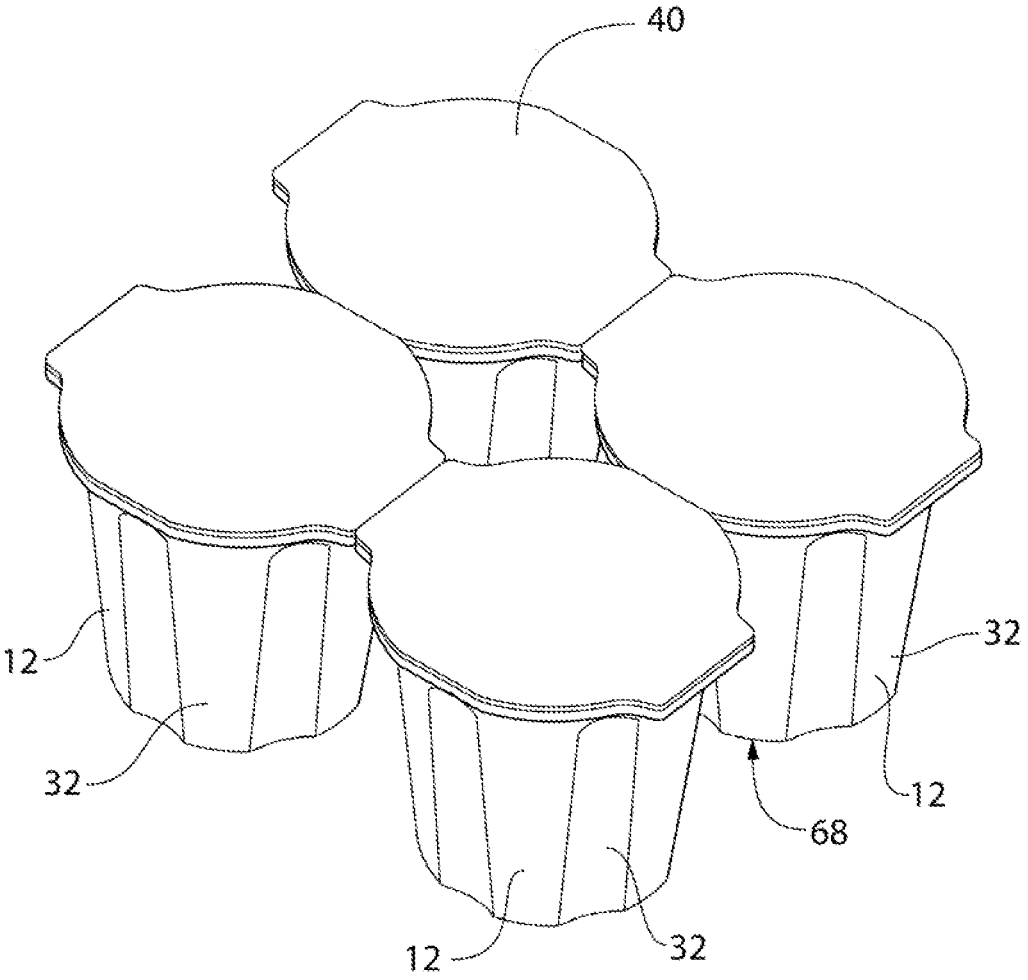
FIG. 6 is a perspective view of a plurality of interconnected secondary refill containers formed from the chamber portions of FIG. 5.
Figure 7A:
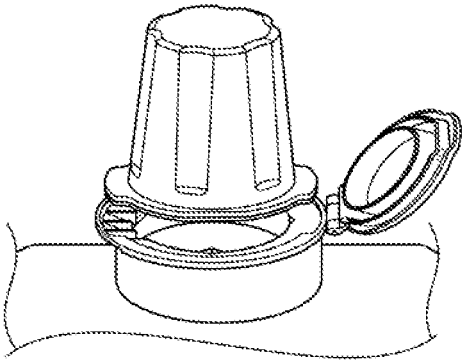
FIGS. 7(*a*) to (*d*) illustrate a sequence of steps for fining the secondary refill container of FIG. 3 to the primary storage container of FIG. 1.
Figure 7B:
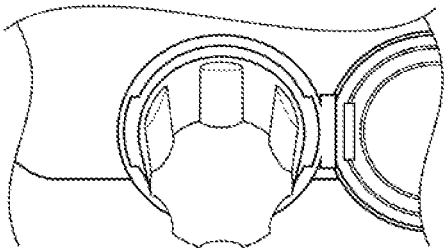
Figure 7C:
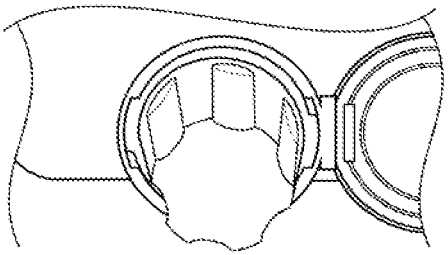
Figure 7D:
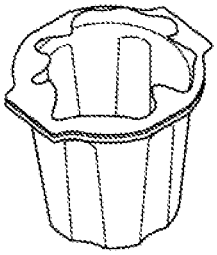

As shown in FIGS. 5 and 6, the secondary refill container 32 is provided in an assembly 68 of plural secondary refill containers 32, with at least some adjacent containers 32 of the assembly 68 being temporarily interconnected by respective adjacent flange tabs 46 having a line of weakening 70 therebetween. The frangible film 40 covers the assembly 68 and seals the secondary refill containers 32. Each secondary refill container 32 may be separated from the assembly 68 by tearing along the lines of weakening 70.

Referring to FIG. 7, there is shown a sequence of steps for fitting the secondary refill container 32 to the primary storage container 2.

In FIG. 7(*a*) the tabs 46 of the flange 36 are aligned with the openings 58 in the locking surface 54.

In FIG. 7(*b*) the tabs 46 are inserted into the openings 58 so that the flange 36 is seated against the sealing surface 48. At the same time, the cutting elements 14 pierce the frangible film 40.

In FIG. 7(*c*), the secondary refill container 32 is rotated in the fitting 10. This causes the tabs 46 of the flange 36 to be received in the gap 56 between the sealing surface 48 and the locking surface 54. This bayonet locking action not only captures the secondary refill container 32 in the fitting 10 but also cuts at least one arcuate cut, by the action of the respective cutting element or elements 14, through the frangible film 40 when the first and second bayonet couplings 42, 44 are mutually rotated during coupling of the secondary refill container 32 to the primary storage container 2 as a closure 12 over the outlet 8 of the primary storage container 2. The frangible film 40 is cut so that the contents of the secondary refill container 32 are dispensed into the primary storage container 2.

FIG. 7(*d*) shows the cut frangible film 40 after dispensing. After dispensing, the secondary refill container 32 may be used as a closure 12 over the outlet 8, as shown in FIG. 4.

Figure 8:
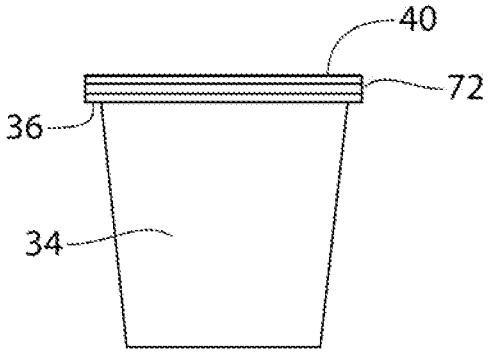
FIG. 8 is a side view of a secondary refill container according to a second embodiment of the present invention.

Referring to FIG. 8, the secondary refill container 32 may further comprise a gasket member 72 around the annular flange 36, the gasket member 72 being located between the annular flange 36 and the frangible film 40. Alternatively the gasket member may be on an outer surface of the frangible film. Typically, the gasket member 72 comprises an expanded polymer, such as polystyrene. The gasket member 72 provides an enhanced seal between the annular flange 36 and the sealing surface 48.

In another alternative embodiment, the frangible film 40 may be made of a compressible material such as an expanded polymer, for example expanded polystyrene, so that the frangible film 40 can function as a gasket to provide an enhanced seal between the annular flange 36 and the sealing surface 48.

Figure 9:
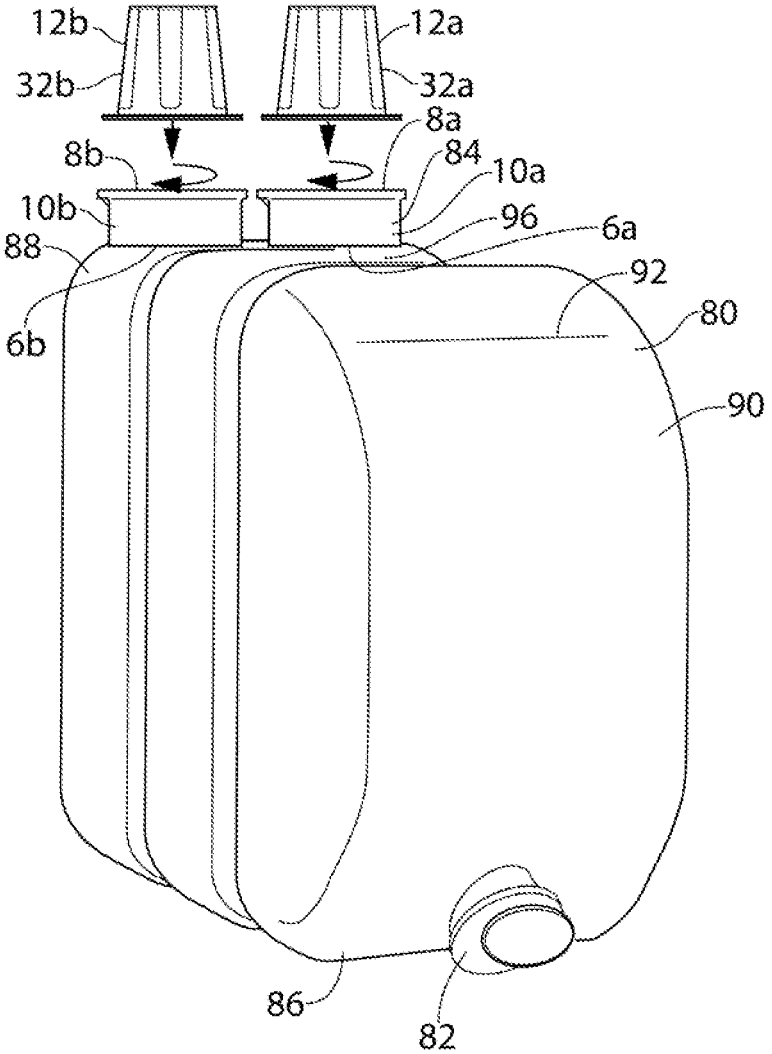
FIG. 9 is a front view of a primary storage container in the form of a bottle according to a third embodiment of the present invention.

FIG. 9 shows a further embodiment of a primary storage container in the form of a bottle according to the invention. In this embodiment, the primary storage container 80 has a further outlet and closure assembly 82 at a location remote from the fitting 84 for the secondary refill container 32, in particular at a lower end 86 of the primary storage container 80. The neck portion, the annular fitting and the at least one cutting element, as disclosed above for the first embodiment, are at an upper end 88 of the primary storage container 80.

Also in this embodiment, the primary storage container 80 has two neck portions 6*a*, 6*b* extending from the body portion 90, each neck portion 6*a*, 6*b* providing a respective outlet 8*a*, 8*b* of the primary storage container 80. As disclosed above for the first embodiment, each neck portion 6*a*, 6*b* has a respective annular fitting 10*a*, 10*b*, provided with one or more cutting elements, for fitting a respective secondary refill container 32*a*, 32*b* as a closure 12*a*, 12*b*. Correspondingly, two of the secondary refill containers 32*a*, 32*b* are provided. Typically, each fitting 10*a*, 10*b* has a respective color, preferably corresponding to a color of a respective secondary refill container 32*a*, 32*b*. The primary storage container 80 includes a fill-line 92 and an integral handle 94.

In this embodiment, different refill compositions can be individually, and sequentially or simultaneously, dispensed from respective secondary refill containers 32*a*, 32*b* into the primary storage container 80. The color coding assists the user correctly coupling the respective secondary refill container to the respective annular fining. The refill compositions may be concentrates, with water previously or subsequently being filled up to the fill-line 92. The resultant diluted composition may be dispensed or decanted from the lower outlet and closure assembly 82 without inverting or tipping the primary storage container 80.

The preferred embodiments of the invention can provide a packaging system which employs individually packaged unit doses of concentrated compositions in secondary refill containers, as smaller containers, which are designed to be coupled with, and emptied into, primary storage containers, as larger containers. The dispensed concentrate can be combined with water in the larger container for the purpose of reconstitution of a diluted composition. This can provide a liquid composition having a predefined concentration of the active components which is suitable for consumer use. The larger container can be reusable.

The larger container can be provided with more than one base surface that it can sit on, to facilitate various orientations.

These orientations can provide a vertical orientation conducive to blow molding of the container. In extrusion blow molding (EBM), a neck finish centered with the axis of the bottle allows it to be blown with less resin than a neck finish offset to one side of the axis. For injection stretch blow molding (ISBM), the neck finish needs to be on or close to the axis of the preform and the bottle geometry needs to be close to symmetrical. The provision of a primary base surface opposite the neck finish allows for a more conventional and efficient blow molding process, while the provision of an additional secondary base surface opposite the neck finish provides the pouring or decanting benefits of a side spout.

These orientations can also provide that during filling the container can sit on the same primary base surface in the vertical orientation used for blow molding, so the opening of the neck finish is oriented vertically upwards for unhindered filling. Such an orientation is it on a production line where filling nozzles commonly need clearance to plunge into the bottle. Such an orientation is also aligned with the typical downward flow of water from a faucet which is used by the consumer to refill the bottle, since filling water from the faucet is a key step to reconstituting the concentrated product. Regardless of whether the concentrate from the unit dose cup is a liquid, powder or solid, a vertical drop into the larger container is the quickest and most direct method of evacuation of the smaller container. An indirect path could lead to some of the concentrate being deposited onto ledges.

The provision of a secondary base surface at an inclined angle to the primary base surface allows the container to sit at an alternative orientation with the neck to one side like a spout. This is easier to decant from than a container with a centered and vertically oriented neck. Any additional separate base surface may be used for enhanced retail merchandising of the product.

The provision of an additional base surface, which may or may not be the same as the base surface(s) for blow molding, filling or decanting, can indicate to the consumer the versatility and ease of filling/pouring, and maximize visual impact to the consumer on the display shelf.

By providing the larger container with more than one opening, two options may be provided.

In one option the refill coupling is mounted to one of the opening to permit introduction of concentrate via that opening while the reconstituted diluted product may be dispensed from the other opening.

In another option, more than one refill coupling may be provided, either with or without a dispensing opening. This option is useful when the larger container requires more than one unit dose of concentrate. For example, providing two refill couplings would prompt the user to use two unit doses of the same concentrate, or permit the separately introduction of a combination of concentrates, such as to deliver a fragrance and a specific benefit agent, e.g. a citrus fragrance and an anti-bacterial active. This option may also be used to blending fragrances or benefit agents, e.g. mango and coconut fragrances, or antibacterial and moisturizer benefit agents. This option may also be used to combine active ingredients that have a better shelf life when they are kept separate from each other, e.g. acid and base components.

The larger container may have one or more handle to aid in lifting, holding, pouring/dispensing, filling, and switching between the aforementioned orientations. The handles may be pinch grips, captured handles or through handles depending on the moldable structure permitted by the container manufacturing process.

The larger container may also provide a label area.

The larger container may further provide an indication of a fill level for water within the larger container. The larger container can store the reconstituted product and permit the reconstituted product to be decanted therefrom into subsidiary containers that can dispense the product for direct use to the consumer.

The smaller container is preferably thin walled and disposable, and sealed with a frangible film forming a lid. The smaller container contains product concentrate in forms including, but not limited to, liquid, powder, flakes, strips, pellets, aggregate, tablet, etc. or any combination of these. Since one smaller container is intended to be a unit dose to be combined with water to fill a larger container, the volume capacity of the smaller container is largely determined by the feasible concentrate ratio of the product. Optionally, the concentrate could be filled into an inner package, e.g. a water soluble pouch, a porous package structure such as a porous bag, etc., with the smaller container being an outer package.

The smaller container needs to be rotated to effect the bayonet coupling/uncoupling, and so may be molded with geometry such as strengthening ribs which aid manual grip and enhance the rigidity of the thin walls of the smaller container. If the smaller container doubles as a cap, the thickness of the wall is selected to provide increased rigidity and robustness for repeated manual removal/replacement of the cap.

Optionally, after emptying the concentrate, the smaller container away be left on the refill coupling to function as a cap for the larger container.

If the smaller container is color coded with the packaged type of concentrate composition, this identification benefit may be combined with a color of the closure fitting of the larger container. The refill coupling mounted to the larger container uses a bayonet-style interface to locate and mate the smaller sealed container with the larger one in the correct relative position, ready for the seal to be broken.

Additionally, when the neck finish of the larger container is facing upwardly, the opening of the smaller container is facing downwardly for gravity-assisted evacuation of the smaller container into the larger container. The refill coupling, breaks the seal on the smaller sealed container to release the concentrate by means of piercing, then circumferential cutting. The twisting motion allows one or more blades on the coupling to make a circular cut in the frangible lid. Optionally the blades and angle of rotation permitted can be coordinated to make a cut with less than 360° sweep so the circle of frangible lid remains attached to the smaller container.

Other cutting means such as puncturing and reaming may be alternatively employed.

The refill coupling allows the consumer to open and empty the concentrate without coming into contact with the user's hands, and so the user does not have to wash their hands after the filling operation. This is an important advantage for the consumer since concentrates typically have several times the toxicity of a non concentrated product due to the high concentration of active ingredients. Additionally, concentrates are also likely to contain high concentrations of non-toxic ingredients, e.g. color dyes, which would be undesirable to touch and stain the user's hands with.

Optionally the coupling incorporates a directional spout for pouring out the resulting reconstituted product. Optionally the coupling incorporates a water tight closure to close the larger container. This permits leak-free shaking to help quickly distribute and dissolve the concentrate in water and storage without evaporation or fear of spilling.

Various other modifications of the embodiments of the present invention will readily be apparent to those skilled in the art and are encompassed within the scope of the invention as defined in the appended claims.

What is claimed is:

1. A packaging system comprising:

a) a primary storage container having a body portion of a first volume, a neck portion extending from the body portion, the neck portion providing an outlet of the primary storage container, an annular fitting on the neck portion for fitting a closure onto the primary storage container and at least one cutting element extending outwardly of the fitting in a direction away from the outlet; and b) a secondary refill container having a chamber portion, having a second volume smaller than the first volume, filled with a dose of a refill composition, the chamber portion having an annular flange defining an opening of the chamber portion, and a frangible film covering the opening and attached to the annular flange, wherein the fitting and the flange have complementary respective first and second bayonet couplings which are adapted releasably to lock the flange into the fitting to fit the secondary refill container over the outlet of the primary storage container, and the at least one cutting element is located to cut the frangible film when the first and second bayonet couplings are coupled together.

2. The packaging system of claim 1 wherein the first and second bayonet couplings each comprise a pair of opposed bayonet elements.

3. The packaging system of claim 1 wherein the fitting has a female bayonet coupling and the flange has a male bayonet coupling.

4. The packaging system of claim 3 wherein the male bayonet coupling comprises a plurality of flange tabs.

5. The packaging system of claim 4 wherein the secondary refill container is provided in an assembly of plural secondary refill containers, with at least some adjacent containers of the assembly being temporarily interconnected by respective adjacent flange tabs having a line of weakening therebetween.

6. The packaging system of claim 5 wherein the secondary refill container is composed of a thermoformed polymer.

7. The packaging system of claim 1 wherein the secondary refill container is composed of polyethylene, polypropylene or polyethylene terephthalate, or any one or more of these polymers in a monolayer or in a multi-layer laminate, optionally with a barrier resin layer.

8. The packaging system of claim 1 wherein the frangible film is compressible and comprises a gasket or the secondary refill container further comprises a gasket member around the annular flange.

9. The packaging system of claim 1 wherein the refill composition in the secondary refill container comprises a concentrated liquid hand soap composition.

10. The packaging system of claim 1 wherein the fitting is attached to the neck portion and wherein the at least one cutting element comprises a plurality of blade elements around the outlet and extending upwardly along an edge of the outlet.

11. The packaging system of claim 1 wherein the fitting includes a sealing surface at least partially surrounding the outlet for engaging an end surface of the secondary refill container when the secondary refill container is fitted as a closure over the outlet of the primary storage container, a locking surface spaced from the sealing surface and a gap therebetween for receiving the flange.

12. The packaging system of claim 1, wherein the first bayonet coupling in the fitting includes openings in the locking surface for receiving the second bayonet coupling in the form of bayonet tabs of the flange.

13. The packaging system of claim 1 wherein a plurality of support members is integrally molded to form an upper bearing surface for a portion of the flange when the secondary refill container is fitted as a closure over the outlet of the primary storage container.

14. The packaging system of claim 1 wherein the fitting further comprises a hinged lid for selectively closing the opening in the absence of the secondary refill container.

15. The packaging system of claim 1, wherein the primary storage container has a further outlet and closure assembly at a location remote from the fitting, and wherein the further outlet and closure assembly is at a lower end of the primary storage container and the neck portion, the annular fitting and the at least one cutting element are at an upper end of the primary storage container.

16. The packaging system of claim 1 wherein the primary storage container has at least two neck portions extending from the body portion, each neck portion providing a respective outlet of the primary storage container, each neck portion having a respective annular fitting thereon for fitting a respective closure onto the primary storage container, and each fitting having at least one cutting element extending outwardly thereof in a direction away from the respective outlet; and the packaging system comprising at least two of the secondary refill containers.

17. The packaging system of claim 1 wherein each fitting has a respective color corresponding to a color of a respective secondary refill container.

18. The packaging system of claim 1 wherein the primary storage container has a central longitudinal axis, the neck portion is substantially aligned with the central longitudinal axis, and the body portion has a first base support surface opposite to the neck portion.

19. The packaging system of claim 11 wherein the first base support surface is substantially orthogonal to the central longitudinal axis.

20. The packaging system of claim 1 wherein the at least one cutting element is located to cut at least one arcuate cut through the frangible film when the first and second bayonet couplings are mutually rotated during coupling together.

* * * * *